US008479424B1

(12) United States Patent
Martin et al.

(10) Patent No.: US 8,479,424 B1
(45) Date of Patent: Jul. 9, 2013

(54) VARIABLE POSITION SIGN

(75) Inventors: John D. Martin, Watertown, WI (US); Aaron W. Smith, Watertown, WI (US); Chamy Chiachen Lutz, Oconomowoc, WI (US); Lisa M. Small, Watertown, WI (US)

(73) Assignee: C-M GLO, Inc., Watertown, WI (US)

( * ) Notice: Subject to any disclaimer, the term of this patent is extended or adjusted under 35 U.S.C. 154(b) by 134 days.

(21) Appl. No.: 12/772,521

(22) Filed: May 3, 2010

Related U.S. Application Data

(60) Provisional application No. 61/175,265, filed on May 4, 2009.

(51) Int. Cl.
*G09F 13/04* (2006.01)

(52) U.S. Cl.
USPC ..... 40/576; 40/531; 40/553

(58) Field of Classification Search
USPC ..... 40/553, 576, 484, 508, 509, 531
See application file for complete search history.

(56) References Cited

U.S. PATENT DOCUMENTS

| | | | |
|---|---|---|---|
| 335,130 | A | 2/1886 | Bloomer, Jr. |
| 1,570,980 | A | 1/1926 | Wiegand |
| 1,872,428 | A | 8/1932 | Drury |
| 1,917,956 | A | 7/1933 | Earley |
| 2,302,667 | A | 11/1942 | Duncan |
| 2,354,367 | A | 7/1944 | Ford |
| D162,355 | S | 3/1951 | Smith |
| D162,637 | S | 3/1951 | Ernst |
| 2,556,779 | A | 6/1951 | Ross |
| 2,648,152 | A | 8/1953 | Simpson |
| D188,174 | S | 6/1960 | Thomas |
| 3,056,221 | A | 10/1962 | Brienza |
| D196,703 | S | 10/1963 | Biommel, Jr. |
| 3,203,126 | A | 8/1965 | Eliot |
| 3,295,240 | A | 1/1967 | Garte |
| 3,340,631 | A | 9/1967 | Lyon et al. |
| 3,579,880 | A | 5/1971 | Murphy |
| 3,673,720 | A | 7/1972 | Thornton |
| 3,919,798 | A | 11/1975 | Mutzhas |
| 4,015,349 | A | 4/1977 | Dunne |
| 4,021,946 | A | 5/1977 | Bradshaw |
| 4,024,532 | A | 5/1977 | Sherwin |

(Continued)

OTHER PUBLICATIONS

Exhibit A—Open Sign manufactured and sold by Everbrite, LLC at least as early as Dec. 7, 2007.

(Continued)

*Primary Examiner* — Joanne Silbermann
*Assistant Examiner* — Kristina Junge
(74) *Attorney, Agent, or Firm* — Boyle Fredrickson, S.C.

(57) ABSTRACT

A sign for the displaying of a number of characters in either a first orientation or at least one additional orientation. The sign includes a frame and a series of characters, including at least one variable position character, mounted to the frame. The variable position character is movable relative to the frame such that it may be read in different positions, to display a message when the variable position character is either in a first orientation or a second orientation. The variable position character may be interconnected with the frame via a pivoting mechanism for adjusting the orientation of the variable position character. The pivoting mechanism may include a latching mechanism that secures the variable position character in a selected orientation. The characters may each include a source of illumination, such as LEDs, that are interconnected with a power supply for selectively illuminating the LEDs.

28 Claims, 16 Drawing Sheets

U.S. PATENT DOCUMENTS

| | | | | |
|---|---|---|---|---|
| 4,155,189 | A | 5/1979 | Engman | |
| 4,169,327 | A | 10/1979 | Stilling | |
| 4,201,003 | A | 5/1980 | Witt | |
| 4,318,098 | A | 3/1982 | McGreevy | |
| 4,373,283 | A | 2/1983 | Swartz | |
| 4,430,819 | A | 2/1984 | Chandler | |
| 4,530,177 | A | 7/1985 | Kane | |
| 4,654,101 | A | 3/1987 | Kane | |
| 4,852,285 | A | 8/1989 | Kimoto | |
| 4,854,062 | A * | 8/1989 | Bayo | 40/551 |
| 4,862,616 | A | 9/1989 | Honeycutt | |
| 4,953,067 | A | 8/1990 | Moore | |
| 4,986,017 | A | 1/1991 | Eckert | |
| 5,002,181 | A | 3/1991 | Leppo | |
| 5,143,285 | A | 9/1992 | Wise | |
| 5,146,704 | A | 9/1992 | Dugan | |
| 5,237,765 | A | 8/1993 | Vargish, II | |
| 5,267,404 | A | 12/1993 | Kizy | |
| 5,315,775 | A | 5/1994 | Parker et al. | |
| 5,450,811 | A | 9/1995 | Heiland | |
| 5,493,804 | A | 2/1996 | Lo et al. | |
| 5,524,371 | A | 6/1996 | Hunter | |
| 5,533,286 | A | 7/1996 | Fallon et al. | |
| 5,536,558 | A | 7/1996 | Shelton | |
| 5,572,816 | A | 11/1996 | Anderson, Jr. et al. | |
| 5,579,598 | A | 12/1996 | Fallon et al. | |
| 5,649,379 | A | 7/1997 | Hoffman et al. | |
| 5,687,939 | A | 11/1997 | Moscovitch | |
| 5,726,535 | A | 3/1998 | Yan | |
| 5,890,306 | A * | 4/1999 | Smith | 40/576 |
| 5,901,483 | A | 5/1999 | Tijanic | |
| 5,992,067 | A | 11/1999 | Strawbridge | |
| 6,023,869 | A | 2/2000 | Durbin | |
| 6,042,248 | A | 3/2000 | Hannah et al. | |
| 6,050,716 | A | 4/2000 | Hsu | |
| 6,076,294 | A | 6/2000 | Durbin | |
| 6,094,849 | A | 8/2000 | Phillips et al. | |
| 6,134,819 | A | 10/2000 | McClain et al. | |
| D433,453 | S | 11/2000 | Fallon | |
| D434,808 | S | 12/2000 | Andersson | |
| 6,177,877 | B1 | 1/2001 | Munyon | |
| 6,192,610 | B1 | 2/2001 | Fallon et al. | |
| 6,204,777 | B1 | 3/2001 | Lyons | |
| 6,205,691 | B1 | 3/2001 | Urda et al. | |
| 6,209,243 | B1 | 4/2001 | Tijanic | |
| 6,341,441 | B1 | 1/2002 | Morales | |
| 6,354,028 | B1 | 3/2002 | Gross et al. | |
| D455,789 | S | 4/2002 | Schlueter | |
| D456,850 | S | 5/2002 | Fallon | |
| D460,490 | S | 7/2002 | Fallon | |
| D461,846 | S | 8/2002 | Fallon | |
| 6,460,277 | B1 * | 10/2002 | Tower | 40/1.5 |
| 6,477,799 | B1 * | 11/2002 | Erickson et al. | 40/406 |
| D477,032 | S | 7/2003 | Fallon | |
| 6,606,808 | B2 | 8/2003 | Katz | |
| D484,916 | S | 1/2004 | Fallon | |
| 6,675,515 | B2 | 1/2004 | Fallon et al. | |
| 6,741,324 | B1 | 5/2004 | Kim | |
| 6,753,788 | B1 | 6/2004 | Munyon | |
| D501,516 | S | 2/2005 | Nelson | |
| D507,603 | S | 7/2005 | Nelson | |
| 6,948,446 | B2 | 9/2005 | Greves | |
| 7,000,344 | B2 | 2/2006 | Furlan et al. | |
| D545,907 | S | 7/2007 | Nelson | |
| 7,251,910 | B1 * | 8/2007 | Ming | 40/576 |
| D553,691 | S | 10/2007 | Lane | |
| 7,327,281 | B2 | 2/2008 | Hutchison | |
| 7,365,968 | B2 * | 4/2008 | Chen et al. | 361/679.27 |
| 7,370,602 | B2 | 5/2008 | Greves | |
| D582,988 | S | 12/2008 | Donnelly et al. | |
| D591,797 | S | 5/2009 | Donnelly et al. | |
| D599,410 | S | 9/2009 | Kaoh | |
| D599,411 | S | 9/2009 | Kaoh | |
| 8,109,020 | B2 | 2/2012 | Boyles et al. | |
| 2001/0027618 | A1 | 10/2001 | Fallon et al. | |
| 2001/0045035 | A1 | 11/2001 | Katz | |
| 2002/0145878 | A1 | 10/2002 | Venegas, Jr. | |
| 2003/0049124 | A1 | 3/2003 | Liu | |
| 2004/0255838 | A1 | 12/2004 | Greves | |
| 2004/0255839 | A1 | 12/2004 | Greves | |
| 2005/0157455 | A1 * | 7/2005 | Hernandez et al. | 361/681 |
| 2006/0059742 | A1 | 3/2006 | Pan | |
| 2007/0193089 | A1 | 8/2007 | Hadaya | |
| 2009/0019746 | A1 | 1/2009 | Thissen | |
| 2009/0172987 | A1 | 7/2009 | Kaoh et al. | |
| 2010/0208464 | A1 | 8/2010 | Dalsgaard | |
| 2011/0061276 | A1 * | 3/2011 | Boyles et al. | 40/576 |

OTHER PUBLICATIONS

Exhibit B—Open Sign manufactured and sold by Everbrite, LLC at least as early as Dec. 7, 2007.

Exhibit C—Open Sign manufactured and sold by Everbrite, LLC at least as early as Dec. 7, 2007.

Exhibit D—Open Sign manufactured and sold by Everbrite, LLC at least as early as Dec. 7, 2007.

Gelcore LLC, Tetra Contour Data Sheet, Publication No. SIGN022, Valley View, Ohio, published Jun. 9, 2006.

* cited by examiner

VARIABLE POSITION SIGN

CROSS-REFERENCE TO RELATED APPLICATIONS

This application claims priority to U.S. Provisional Patent Application Ser. No. 61/175,265 filed on May 4, 2009, the entirety of which is hereby incorporated by reference.

BACKGROUND OF THE INVENTION

The present invention relates generally to a sign and particularly to an illuminated sign incorporating a pivoting mechanism whereby the sign may be read in more than one orientation.

Signs for storefronts and the like are well known throughout the art. For instance, signs for indicating whether a particular business is open, i.e., open signs, and the like are well known. Such signs have traditionally utilized neon for illumination of the sign. In such signs, a number of tubes are arranged to spell out the word or words desired such as, e.g., "OPEN". Such tubes are filled with neon and an electrical charge is applied to the gas by way of a pair of opposed electrodes at either end of the tube to thereby illuminate the gas and the tube. Such signs, however, suffer from a number of disadvantages. Neon tubes tend to be very brittle and susceptible to accidental breakage. Further, neon tubing is relatively expensive and thus replacement of the tubes is undesirable and cost prohibitive. In addition, neon tubing is quite rigid in that it is not configurable into a number of different orientations as may sometimes be desirable.

As such, it has become known to provide signs that simulate the appearance of neon tubing by using a plurality of light emitting members such as, for example, light emitting diodes ("LEDs") arranged along the length of a housing and directed to emit light at a waveguide to thereby illuminate the waveguide in a manner that simulates the appearance of neon. Such constructions are advantageous with respect to traditional neon signs in that the waveguides and housing may be produced from a relatively sturdy material such as a plastic and the individual LEDs may be easily replaced when they wear out. Further, as compared to traditional neon signs, the energy needs of these signs are quite small thereby reducing costs to the user. However, such signs still suffer from a number of disadvantages as they are not configurable as may be desired by the user. For instance, a particular storefront may necessitate a sign that orients the letters in a substantially vertical manner while another may necessitate a sign that orients the letters in a substantially horizontal manner. As such, the makers of such signs must produce two different signs to accommodate the needs of all the prospective end users which increases production costs and takes up appreciably more shelf space in retail locations where the signs may be sold, thus further increasing costs to the producer which typically are passed along to the purchaser.

Thus, it is desired to provide a sign that overcomes each of the foregoing disadvantages while maintaining the high quality illumination provided by the sign.

SUMMARY OF THE INVENTION

The present invention is directed to a sign configured for the display of a number of individual letters, numbers, or other such characters. The sign includes a frame for mounting of at least one character. The character or characters mounted to the frame of the sign include at least one variable position character. The variable position character is configured to be movable with respect to the frame such that it may be read by an observer in a plurality of positions. The sign may include a rear cover selectively attached to the frame for covering components of the sign. The characters of the sign may include lights in communication with a power assembly for illumination of the characters. The lights of the sign may comprise LEDs that are selectively interconnected with the power assembly for selectively illuminating the LEDs. The sign may be configured to display a message when the variable position characters are positioned in a first orientation and when positioned in a second orientation. The variable position characters may be interconnected with the frame by way of a pivoting mechanism about which the variable position characters rotate for adjusting the orientation of the variable position characters with respect to the frame. The pivoting mechanism may additionally include a latching mechanism adapted to selectively secure the variable position characters in a selected orientation.

Other aspects, features, and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

DESCRIPTION OF THE DRAWINGS

An exemplary embodiment of the invention is illustrated in the accompanying drawings in which like reference numerals represent like parts throughout.

In the drawings.

DETAILED DESCRIPTION

Figure 1:
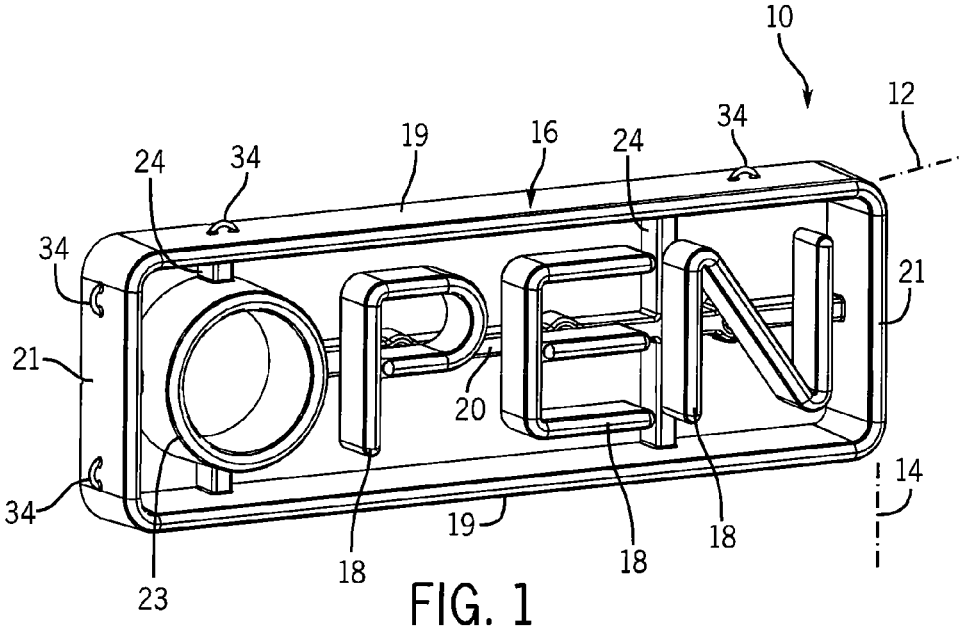
FIG. 1 is an isometric view of a sign according to the present invention in a first orientation.
Figure 4:
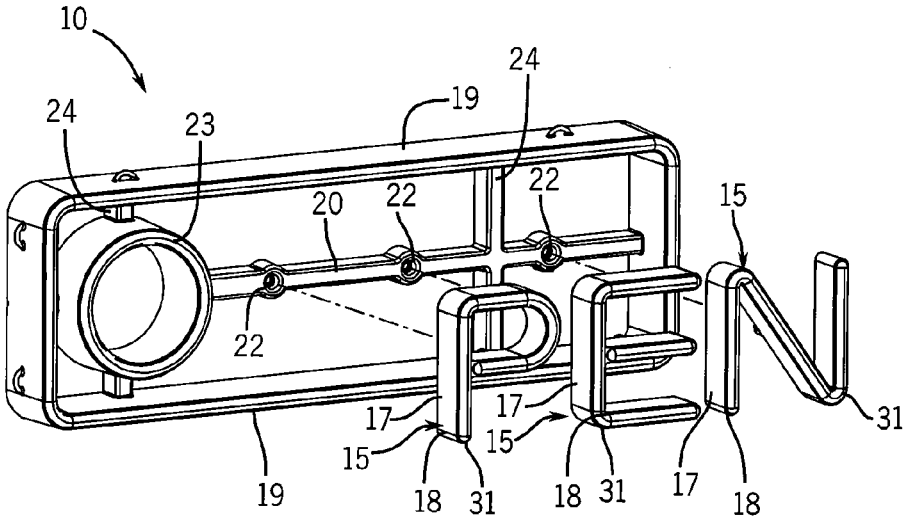
FIG. 4 is a partially exploded isometric view of the sign of FIG. 1.

Referring now to the Figures, and initially to FIGS. 1-4, this invention relates to a sign, which may be an illuminated sign, and more specifically to an electronic sign having at least one character that is movable such that the sign may be readable in a variety of orientations such as horizontal, vertical, or any number of positions therebetween. A representative embodiment of the present invention in the horizontal orientation is shown as sign 10 having a generally rectangular configuration defining a long axis 12 and a short axis 14. Sign 10 as illustrated in the Figures is an "Open" sign; however, it is understood that sign 10 may be configured to display a variety of messages as desired. Sign 10 includes a frame 16 configured for mounting one or more pivoting characters 18 thereto as will be explained in detail further below. Frame 16 comprises a pair of elongated walls or panels 19 extending in a direction parallel to long axis 12 and a pair of short walls or panels 21 extending parallel to short axis 14 to form an interior within which pivoting characters 18 are located. Pivoting characters 18 preferably comprise LED housings or similar such electric or electronic lighting elements of the kind known in the art. Pivoting characters 18 are arranged so as to display a particular message. As will be explained in detail herein, pivoting characters 18 are configured such that they may be rotated to more than one position such that sign 10 may be readable in a plurality of orientations such as, but not limited to, horizontal, vertical, and diagonal.

Frame 16 is preferably constructed from a relatively sturdy material that is generally lightweight such as plastic. Frame 16 is preferably constructed by a molding process of the kind generally known in the art. Alternatively, frame 16 may be constructed from a relatively lightweight metal such as aluminum or the like through an extrusion or similar such process.

Figure 3:
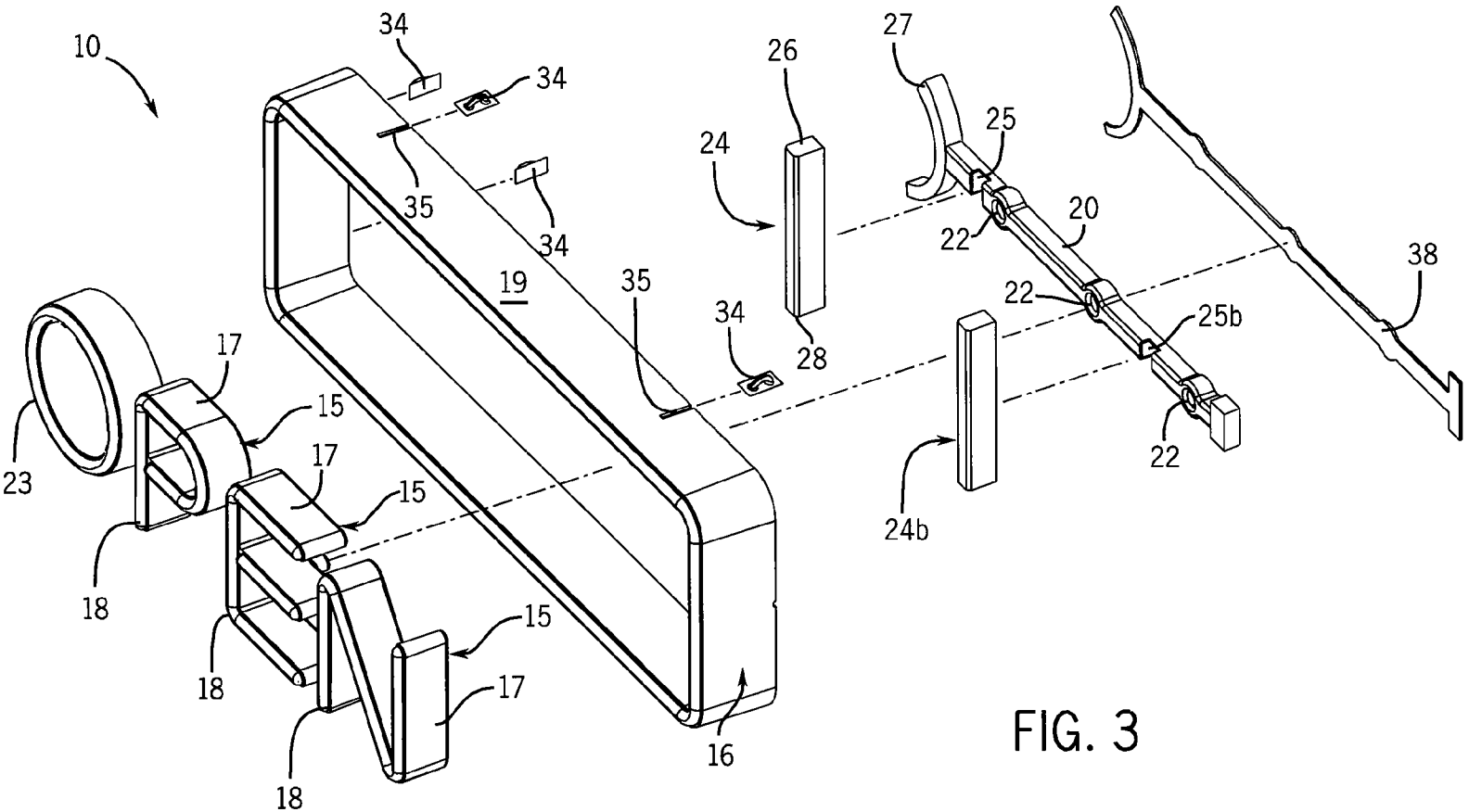
FIG. 3 is an exploded isometric view of the sign of FIG. 1.
Figure 5B:
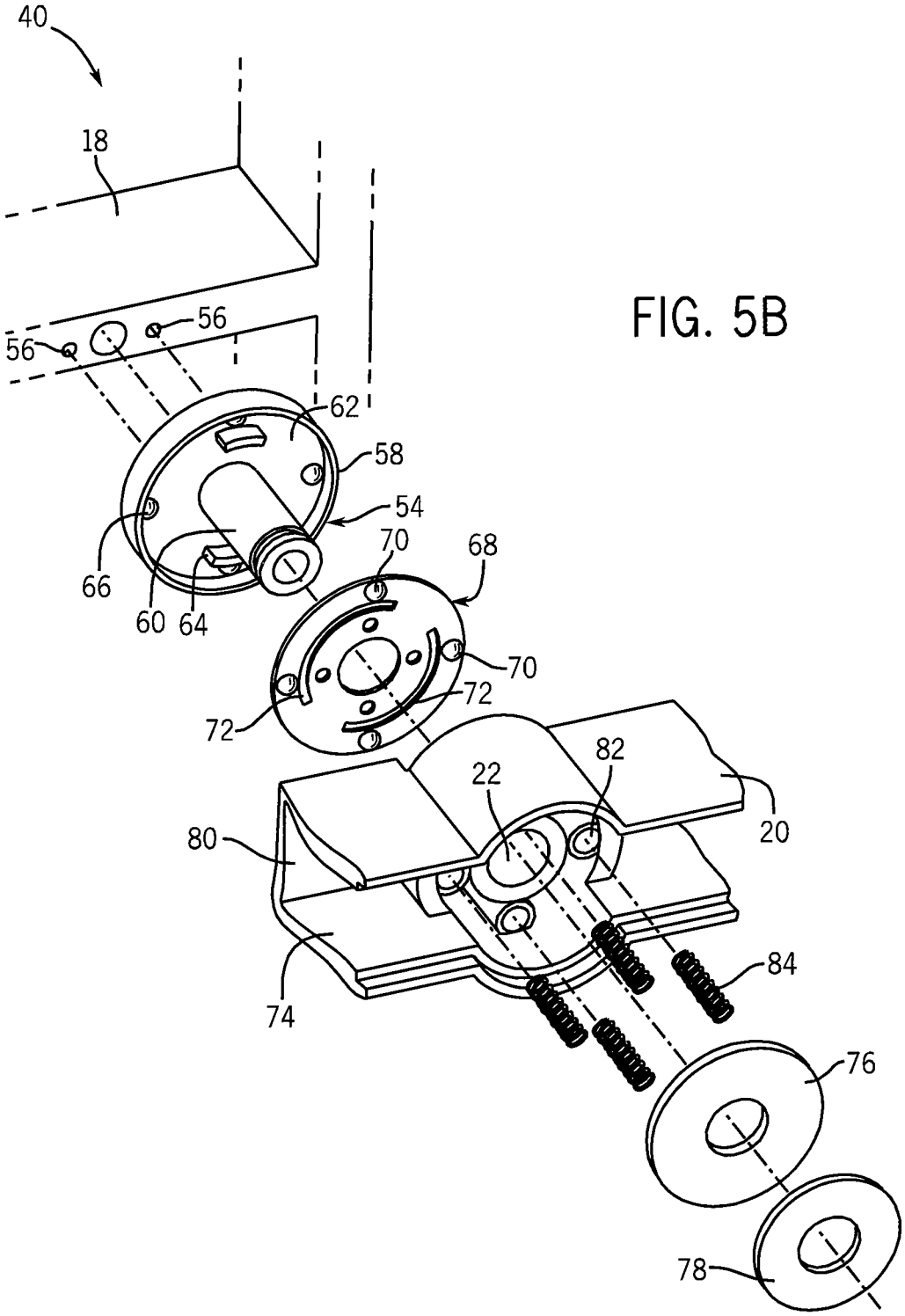
FIG. 5B is a partial exploded isometric view of a second embodiment of a pivoting mechanism that may be incorporated into the sign of FIG. 1.

Frame 16 includes a centrally positioned character mounting member 20 that extends along the long axis 12 of sign 10 and that is fixed to frame 16 at one or both ends thereof. Character mounting member 20 includes three apertures 22 that are configured for receiving and mounting pivoting characters 18. As is readily understood, character mounting member 20 may be configured with any number of apertures 22 so as to accommodate a variety of different designs. In the embodiment illustrated, character mounting member 20 may be secured to and extend from a fixed character 23 integrally formed with frame 16. In the illustrated embodiment, the fixed character 23 is in the form of the letter "0," which has the same appearance regardless of the orientation of the sign 10. Alternatively, fixed character 23 may comprise a separate member that is snap-fit or otherwise coupled to character mounting member 20 and frame 16. For instance, as shown in FIG. 3, fixed character 23 comprises the letter "O" of the "Open" sign, and the letter "O" is received by a generally arcuate portion 27 of character mounting member 20 to secure the letter "O" thereto. It is understood that fixed character 23 may be positioned at any point along the length of character mounting member 20 and frame 16. Further, it is understood that sign 10 may comprise one or more additional fixed characters 23 at any point along the long axis 12 of the sign or, alternatively, none at all. Fixed character 23 preferably is a letter, number, or other symbol that looks the same when viewed, for example, horizontally or vertically such that rotation thereof is unnecessary as will be explained in further detail here. Alternatively, fixed character 23 may have a different appearance in each orientation of sign 10, and is preferably configured such that the character contributes to the design or meaning of the sign 10 in each orientation. Character mounting member 20 may be supported by a support bar 24 extending along short axis 14 between walls 19 at a location between the fixed character 23 and the far wall 21. Support bar 24 may be integrally formed with character mounting member 20 or may be separately attached thereto. Character mounting member 20 may include a recess 25 formed in a surface thereof for receiving and securing support bar 24 therein. Support bar 24 has a first end 26 and a second end 28 coupled between the two inside surfaces of walls 19 respectively of frame 16 for securing support bar 24 to frame 16. If desired, a second support bar 24*b* (FIG. 3) may be provided along frame 16 for supporting character mounting member 20. Similarly, second support bar 24*b* may be secured in a recess 25*b* of character mounting member 20.

Frame 16 includes two pairs of hangars 34 secured within two pairs of notches 35 such that the hangars 34 extend outwardly from exterior surfaces of one of walls 19 and 21 of frame 16. A first pair of hangars 34 is provided on one of walls 19 for mounting or otherwise hanging sign 10 in a horizontal orientation. The hangers 34 are mounted in a spaced manner such that one of hangers 34 is mounted near a first end of sign 10 and the other of hangers 34 is mounted near a second end of sign 10. In this manner, the sign 10 may be hung in a relatively even manner such that the weight of sign 10 is distributed across sign 10 when hung. A pair of hangars 34 is similarly provided on one of walls 21 for hanging sign 10 in a vertical orientation. To mount sign 10 to a wall or other surface, a pair of fasteners (not shown), or a chain or the like, may be inserted through the apertures of hangars 34 to secure sign 10 to a wall as is readily understood. The hangars 34 may also be attached in alternative manners. The sign 10 may also not have any hangers 34 in which case it may be mounted with keyholes or designed to stand on a counter or in any other known manner.

Sign 10 further includes a rear cover 38 configured to matingly cooperate with frame 16. Rear cover 38 is configured to protect the rear portion of sign 10 from tampering or otherwise being damaged. Further, rear cover 38 is configured for abutting against a wall or other mounting surface.

Figure 6:
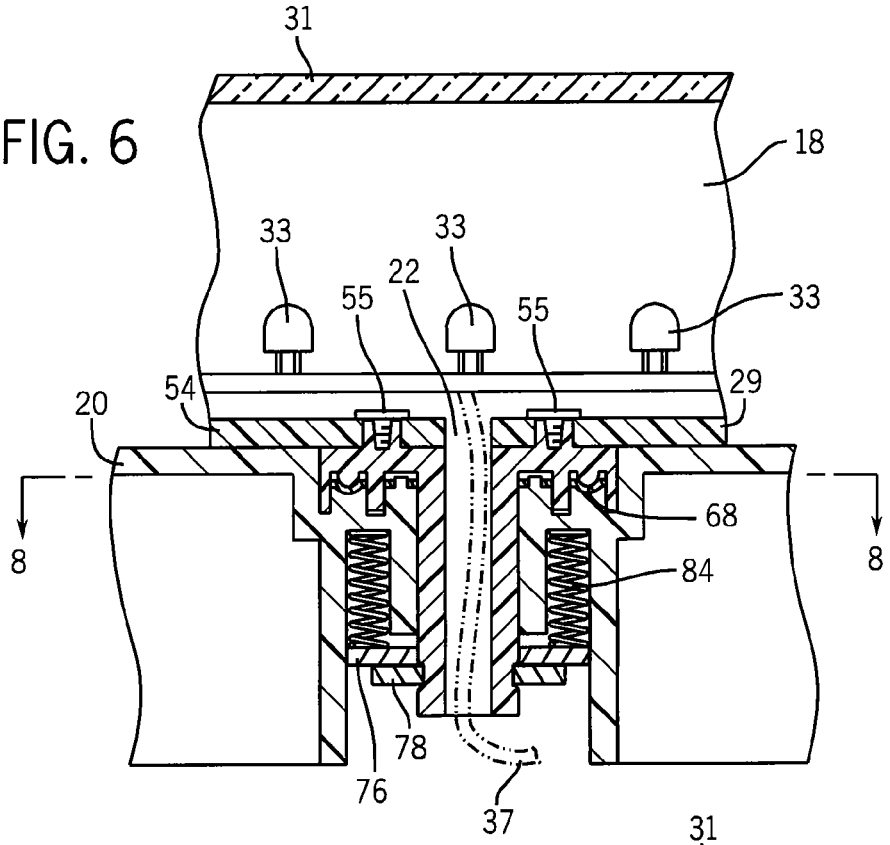
FIG. 6 is partial cross-section of the assembled pivoting mechanism of FIG. 5A in a first position.
Figure 7:
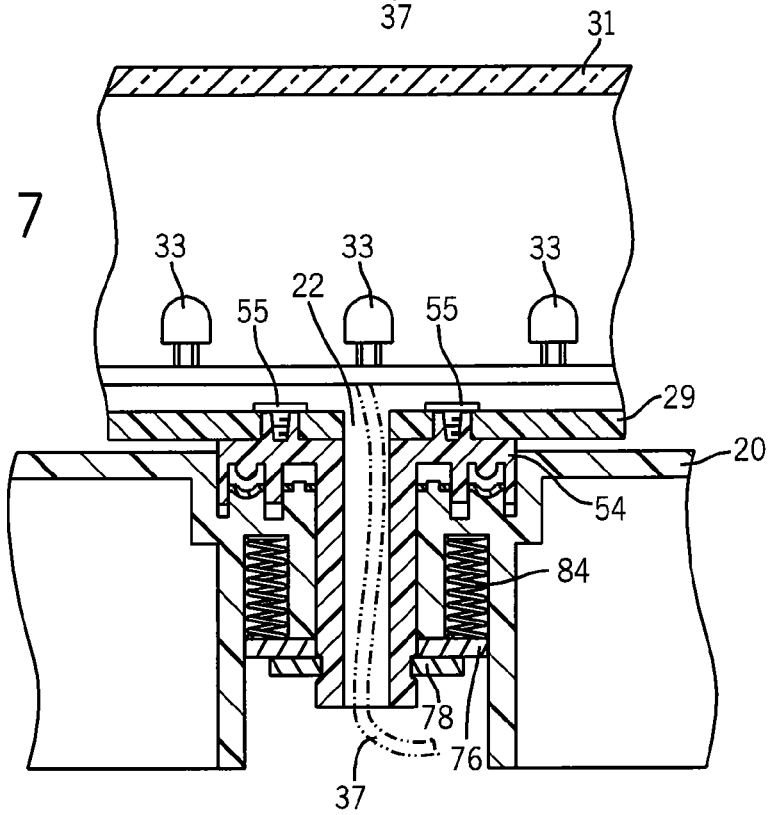
FIG. 7 is a partial cross-section of the assembled pivoting mechanism of FIG. 5A in a second position.

Pivoting characters 18 and fixed character 23 of sign 10 are generally LED or other such electrical or electronic lighting fixtures configured in the shape of letters, numbers, or other symbols. Referring momentarily to FIGS. 6-7, cross-sections through a portion of one of pivoting characters 18 are shown. Pivoting character 18 comprises a housing 15 constructed from plastic or a similar such material. Housing 15 may be constructed from a relatively opaque material and be black or another dark color in appearance. Housing 15 defines a pair of sidewalls 17 and a rear wall 29 opposite an open, forward facing portion configured to receive a relatively translucent waveguide 31. Translucent waveguide 31 is preferably constructed from a plastic or similar material. A plurality of light emitting diodes 33 are mounted within housing 15 between rear wall 29 and translucent waveguide 31. LEDs 33 are positioned in one or more rows about the entirety of the pivoting character 18 such that light emitted by LEDs 33 is directed toward a rear surface of translucent waveguide 31 such that light imparted upon the translucent waveguide 31 is directed out through a front surface of the translucent waveguide 31 to illuminate the pivoting character 18. LEDs 33 may be mounted to a circuit board or similar support means such that the LEDs 33 are provided in communication with a source of electricity for providing power to the LEDs 33. More preferably, the illumination provided by the LEDs according to the present invention may resemble neon lighting as is generally understood. Alternatively, sign 10 may be constructed as channel letters or other such designs that are not constructed to simulate neon. It is generally understood that fixed character 23 is constructed in a manner similar to that of pivoting characters 18.

Pivoting characters 18 and fixed character 23 are in communication with a power source (not shown) configured to provide electricity thereto so as to illuminate the pivoting characters 18 and fixed character 23. For example, pivoting characters 18 and fixed character 23 may include a power cord or other such wiring 37 coupled thereto and configured for coupling to a power source such as a wall outlet (not shown) to provide power thereto.

Figure 5A:
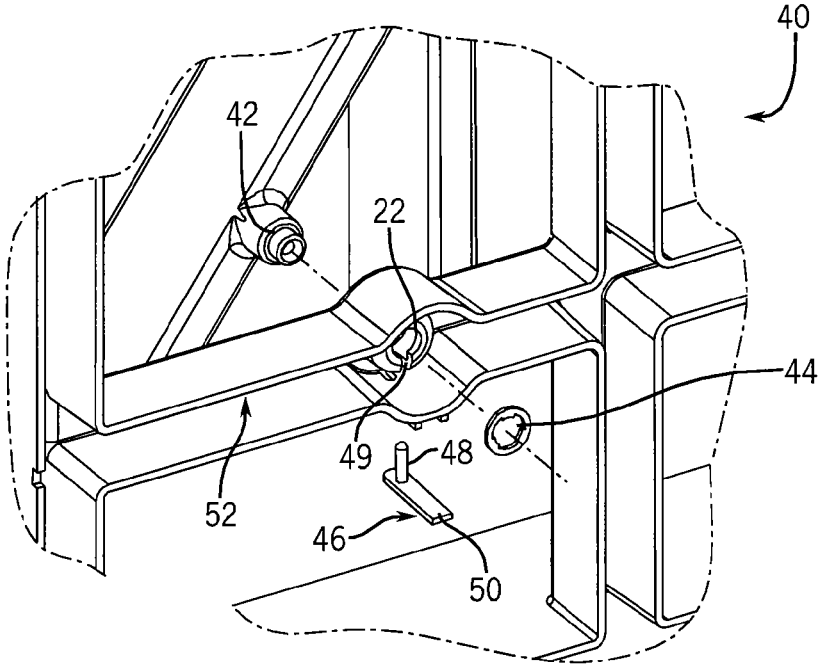
FIG. 5A is a partial exploded isometric view of a first embodiment of a pivoting mechanism that may be incorporated into the sign of FIG. 1.
Figure 2:
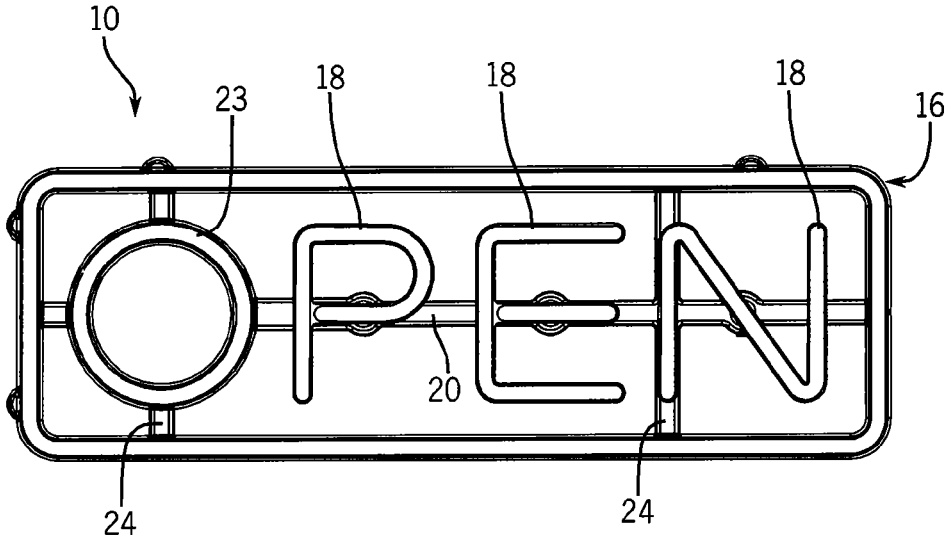
FIG. 2 is a front elevation view of the sign of FIG. 1.

Referring now to FIG. 5A, a first embodiment of a pivoting mechanism 40 according to the present invention is illustrated. In pivoting mechanism 40, the pivoting characters 18 include rearwardly extending posts 42 for mounting pivoting characters 18 to the frame 16. In particular, posts 42 are configured for insertion into apertures 22 of letter mounting member 20. Posts 42 are generally hollow to thereby allow the wiring 37 or other electric coupling insertion therethrough. A retainer ring 44 is provided for securing each post 42 within its respective aperture 22. Preferably, each retainer ring 44 is configured to receive an end of post 42 that extends through the aperture 22. Retainer rings 44 are preferably configured to matingly receive the ends of the post 42 to securely hold post 42 within aperture 22. A spring and pin assembly 46 is also provided for securing pivoting characters 18 in place. Spring and pin assembly 46 comprises a pin 48 extending along short axis 14 through a notch 49 in the wall defining aperture 22. Pin 48 is formed integrally with and extends away from a spring body 50 configured to be slidingly inserted into a channel 52 provided beneath apertures 22. Pin 48 is configured to engage post 42 such that each pivoting character 18 is secured into place. Spring and pin assembly 46 may be removed from channel 52 to thereby permit rotation of pivoting characters 18 such that the orientation of sign 10 may be changed.

Referring now to FIGS. 5B-10 an alternative, preferred embodiment of the pivoting mechanism 40 of the present invention is illustrated. Pivoting mechanism 40 according to the preferred embodiment includes a turntable 54 mounted to the back side of the pivoting character 18 by way of a pair of fasteners 55 received in apertures 56 of pivoting character 18. Turntable 54 may be constructed from injection molded nylon or similar such material. Turntable 54 includes a generally rounded base 58 having an integrally, centrally mounted hollow rod 60 that extends rearward from a relatively flat surface 62 toward mounting member 20 for receipt within the aperture 22. Surface 62 includes a pair of generally arcuate flanges 64 that extend rearwardly from surface 62. Flanges 64 are approximately rectangular in cross-section and are disposed on opposing sides of rod 60 on surface 62. A series of projections 66 are provided about the surface 62 and disposed at generally equidistant positions with respect to one another about a perimeter of surface 62. Projections 66 are generally rounded bumps that extend rearwardly from surface 62 much like the flanges 64. Flanges 64 and projections 66 are generally formed by way of molding or embossing onto surface 62 as is readily understood, or may be formed in any other satisfactory manner.

A spacer 68 is provided between the turntable 54 and mounting member 20. Spacer 68 is preferably constructed from steel, nylon, or other such material. Spacer 68 is generally flat and includes four complementary depressions 70 formed over the surface of spacer 68 that face pivoting character 18, and are configured and arranged so as to correspond to the projections 66 of turntable 54. Depressions 70 are preferably formed by way of molding or debossing or similar such process. In this manner, depressions 70 are capable of matingly receiving projections 66 of turntable 54 to thereby define a point of contact therebetween. Spacer 68 further includes a pair of arcuate slots 72 formed therethrough and configured to cooperate with flanges 64. In particular, flanges 64 are received through slots 72 to thereby serve as a guide for the pivoting or rotating of pivoting character 18 as will be described. In one embodiment, spacer 68 may be integrated into the adjacent face of member 20.

Character mounting member 20 includes a rearwardly facing channel 74 through which an end of the rod 60 is received and secured in place by way of a washer 76 and a retaining ring 78. Washer 76 is received on rod 60 and engaged with a rearwardly facing wall 80 defined in channel 74. Retaining ring 78 may include a number of grooves around the aperture thereof for engaging a threaded portion of rod 60 as is readily understood. In this manner, retaining ring 78 prevents the pivoting character 18 from slipping off the character mounting member 20. The channel 74 further includes four depressions 82 for receiving and engaging four corresponding springs 84. Springs 84 are provided in order to allow a limited amount of axial movement between the pivoting character 18 and the member 20 during rotation.

Figure 8:
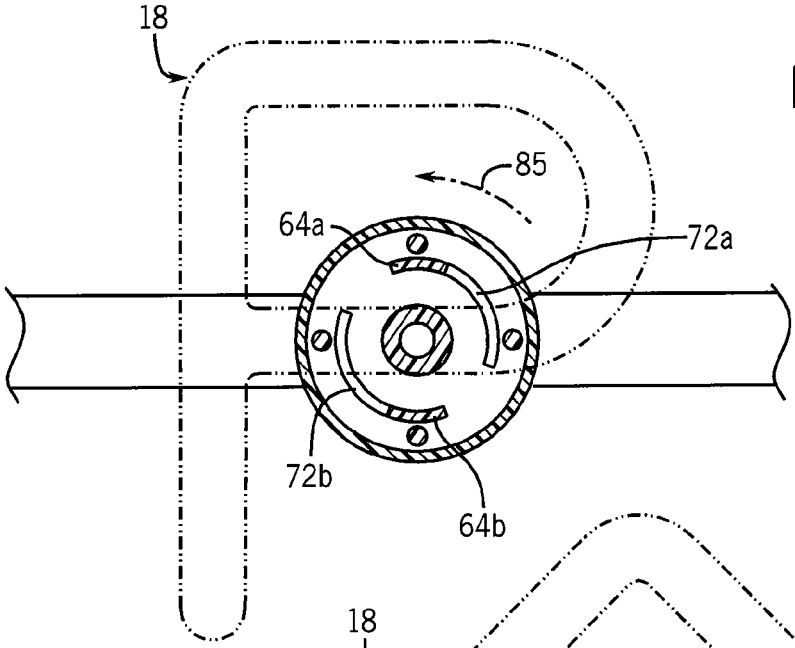
FIG. 8 is front elevation view of a variable orientation character incorporated into the sign of the FIG. 1 using the pivot mechanism of FIG. 5B in a first orientation, with reference to line 8-8 of FIG. 6, the variable orientation character being shown in phantom.

Referring now to FIGS. 6 and 8, pivoting mechanism 40 is shown in a first position in which pivoting character 18, in this case the letter "P" of the "Open" sign 10 is placed in a horizontal orientation using a force indicated by arrow 85. In this position, as can best be seen from FIG. 8, the upper one of flanges 64*a* is positioned at a left-most position within one of arcuate slots 72*a* of spacer 68 and the lower one of flanges 64*b* is positioned at a right-most position within arcuate slot 72*b*. The flanges 64*a*, 64*b* and slots 72*a*, 72*b* function to provide a stop structure that positions the pivoting character 18 in a predetermined position, in this case such that the pivoting character 18 is readable when sign 10 is in a horizontal orientation. In this position, the projections 66 of turntable 54 are each engaged with one of the depressions 70 of spacer 68 to thereby releasably secure the pivoting character in place such that it is not freely rotatably under force of gravity. The springs 84 function to bias pivoting character 18 toward the mounting member 20, which thus urges the projections 66 into the depressions 70. While four springs 84 are shown, it is generally understood that any number of springs 84 may be used in practicing the present invention. For instance, the 4 springs 84 may be reduced to a single spring 84 concentric with rod 60 and carrying out the same functions as the 4 springs 84.

Figure 9:
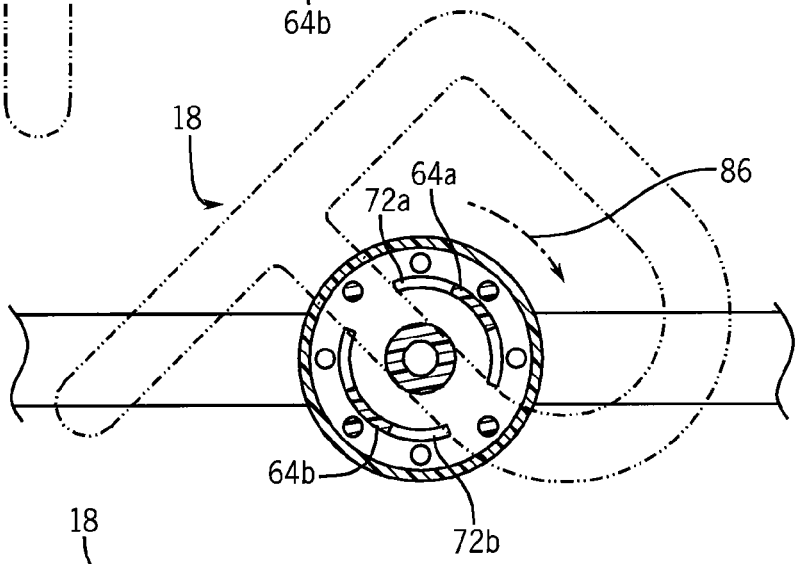
FIG. 9 is a front elevation view of the variable orientation character of FIG. 8, wherein the variable orientation character has been pivoted via the pivoting mechanism to a position part way between the first orientation and a second orientation, the variable orientation character being shown in phantom.

Referring now to FIG. 9, pivoting character 18 is shown as having been rotated via pivoting mechanism 40 to an orientation between horizontal and vertical wherein rotation of pivoting character 18 is noted by arrow 86. In this position, flange 64*a* has been slid along arcuate slot 72*a* to a point mid-way between the left most and right most position of arcuate slot 72*a* and, correspondingly, flange 64*b* has been slid within arcuate slot 72*b* to a position mid-way between the right-most position and left-most position within the arcuate slot 72*b*. Projections 66 have similarly rotated along with turntable 54 to a position such that they are not secured within one of depressions 70. In this way, the pivoting character 18 is free to rotate between its horizontal and vertical orientations. The springs 84 are compressed when pivoting character 18 is in this position, to accommodate the slight outward movement of pivoting character 18 when projections 66 are moved out of the depressions 70.

Figure 10:
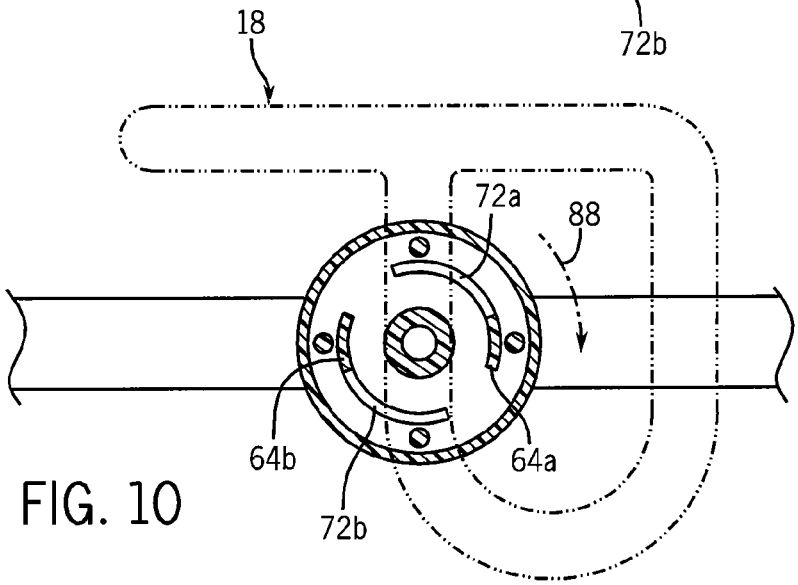
FIG. 10 is a front elevation view of the variable orientation character of FIG. 8, wherein the variable orientation character has been pivoted about the pivoting mechanism to a second orientation, the variable orientation character being shown in phantom.

Referring now to FIGS. 7 and 10, pivoting character 18 is shown as having been rotated via pivoting mechanism 40 to its vertical orientation as shown by arrow 88. In this orientation, flange 64*a* has been rotated to the right-most position within arcuate slot 72*a* and flange 64*b* has been rotated to the left-most position within arcuate slot 72*b*. The flanges 64*a*, 64*b* and slots 72*a*, 72*b* function to provide a stop structure that positions the pivoting character 18 in a predetermined position, in this case such that the pivoting character 18 is readable when sign 10 is in a vertical orientation. Projections 66 have been rotated to cooperate with the depressions 70 of the spacer 68 similar to that seen when pivoting character 18 was in the horizontal orientation. Again, the springs 84 function to bias pivoting character 18 toward the mounting member 20, which thus urges the projections 66 into the depressions 70 so that the pivoting character 18 is secured in place by way of the interplay between the four projections 66 and depressions 70. The springs 84, in combination with the projections 66 and depressions 70, thus function to hold the pivoting character 18 in place such that a certain amount of user-applied force is required to rotate the pivoting character 18 out of position. In this way, the pivoting character 18 is not able to slip out of position under the force of gravity but rather requires an external, applied force to rotate. As noted previously, the springs 84 may be replaced by a single spring 84 concentrically mounted on rod 60.

As is readily understood, in both the horizontal and vertical orientations, the arcuate slots 72 serve to define a maximum point of rotation in that the ends of the arcuate slots 72 are arranged to coincide with the horizontal and vertical orientations of the pivoting character 18.

Figure 11:
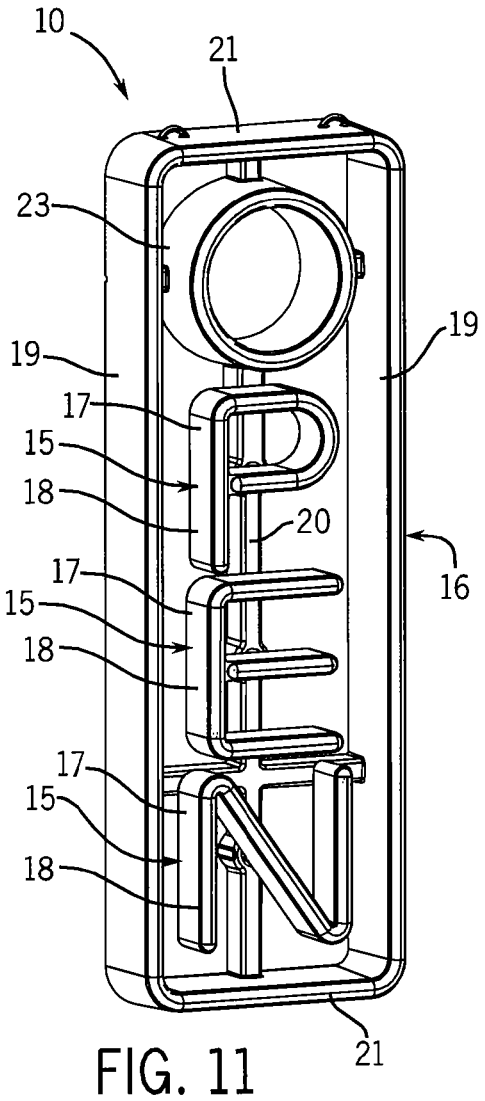
FIG. 11 is an isometric view of the sign of FIG. 1 in a second orientation.
Figure 12:
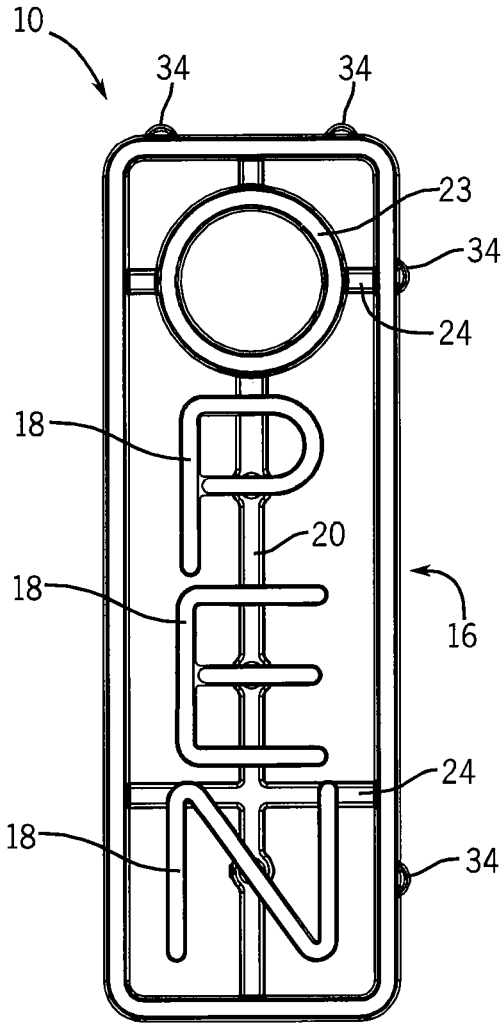
FIG. 12 is a front elevation view of the sign of FIG. 11.
Figure 13:
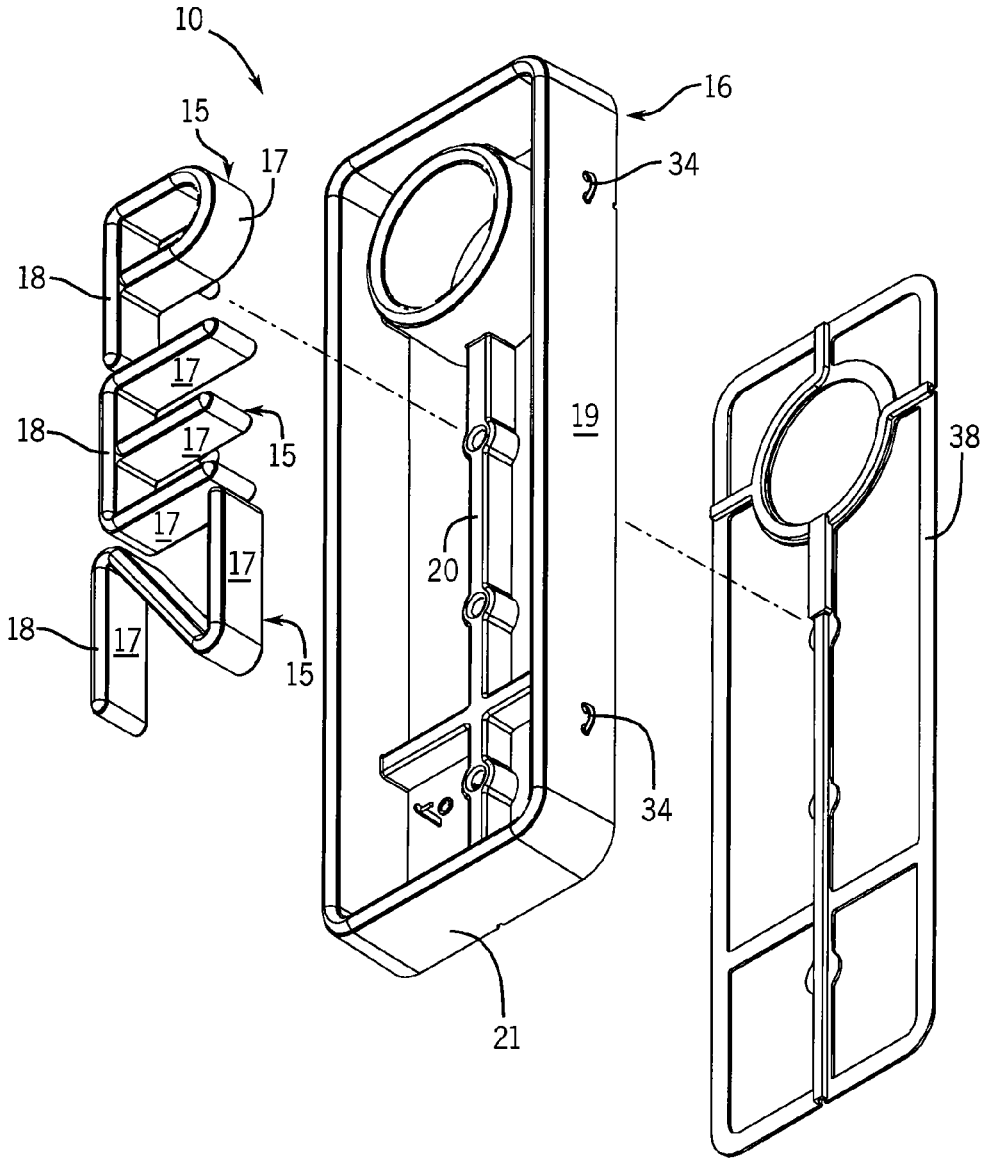
FIG. 13 is an exploded isometric view of the sign of FIG. 11.
Figure 15:
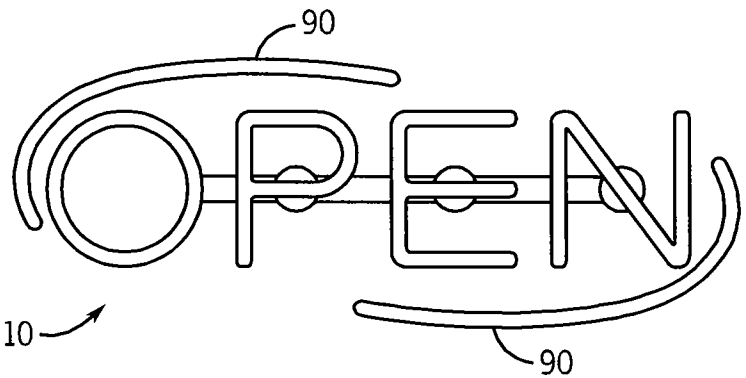
FIGS. 14-15 are front elevation views of another embodiment of the sign according to the present invention in which the sign is shown in two different orientations.
Figure 14:
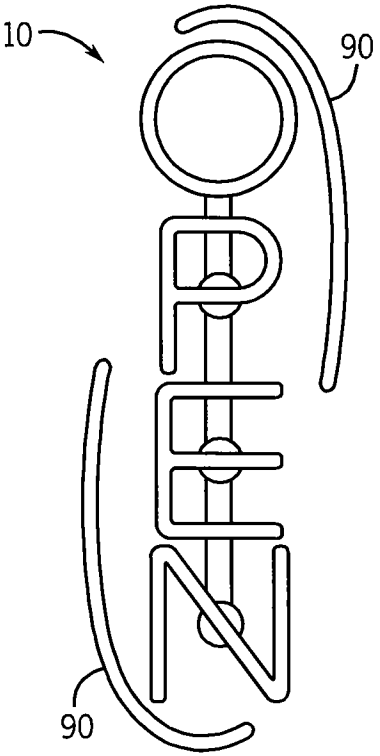
Figure 17:
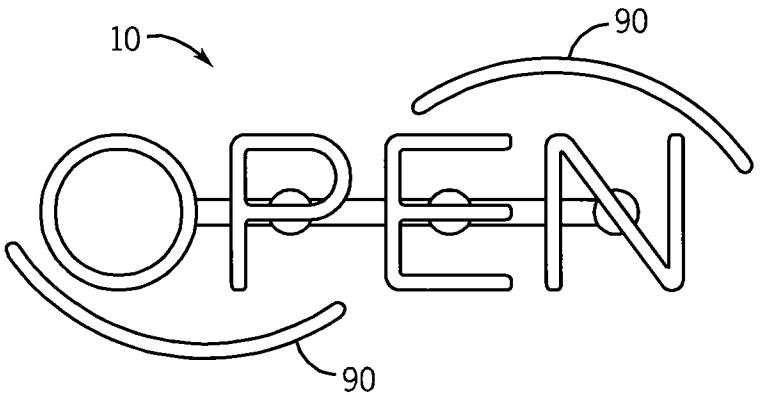
FIGS. 16-17 are front elevation views of another embodiment of the sign according to the present invention in which the sign is shown in two different orientations.
Figure 16:
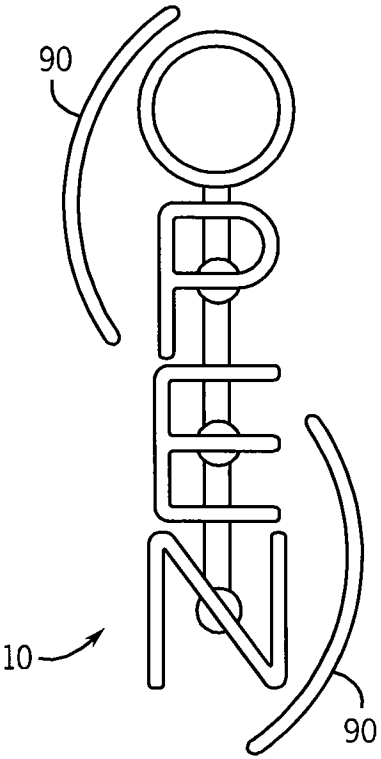

Now referring to FIGS. 11-13, sign 10 is illustrated with pivoting letters 18 oriented vertically. Thus, sign 10 may be mounted in the vertical orientation such that sign 10 may be read.

In operation, pivoting characters 18 may be selectively rotated by an operator of sign 10 such that sign 10 may be oriented in a horizontal, vertical, or generally oblique direction. For instance, as shown in FIGS. 1-4, sign 10 is oriented such that the pivoting characters 18 "P," "E," and "N" of an "OPEN" sign are rotated such that the sign may be read correctly while oriented horizontally. However, if the operator of sign 10 so desires, sign 10 may be rotated to be read in a vertical orientation by individually rotating pivoting characters 18 "P," "E," and "N" such that they read vertically instead of horizontally as shown in FIGS. 11-13.

As shown, fixed character 23 represents the letter "O" of the "OPEN" sign 10 such that fixed character 23 does not require rotation in order to be read in the horizontal or vertical directions as is generally understood. However, it is appreciated that fixed character 23 may alternatively be constructed as a pivoting character like "P," "E," and "N" of "OPEN" sign 10 in keeping with the spirit of the present invention. Likewise, any of pivoting characters 18 may be constructed as fixed character 23 in practicing the present invention. Sign 10 may comprise any number of different messages such as, but not limited to "EXIT," "CAUTION," "VACANCY," etc. Likewise, sign 10 may comprise other characters such as various symbols and numbers. Further, sign 10 may consist of characters of any language. It is understood that sign 10 according to the present invention may be configured such that the letters are rotatable such that the sign may be read diagonally or in other such non-vertical and non-horizontal directions.

Figure 19:
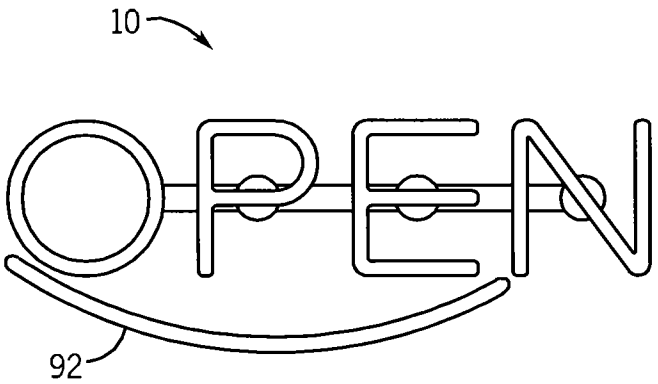
FIGS. 18-19 are front elevation views of another embodiment of the sign according to the present invention in which the sign is shown in two different orientations.
Figure 18:
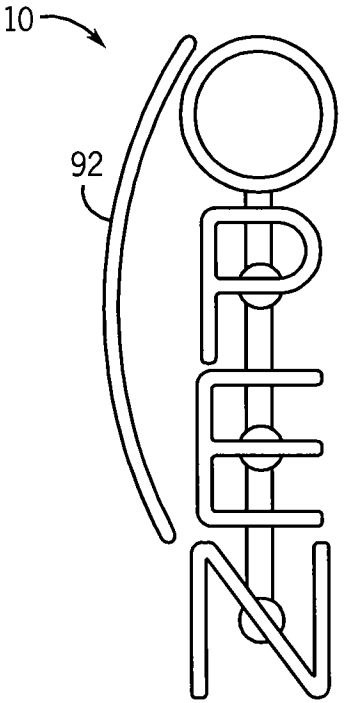
Figure 21:
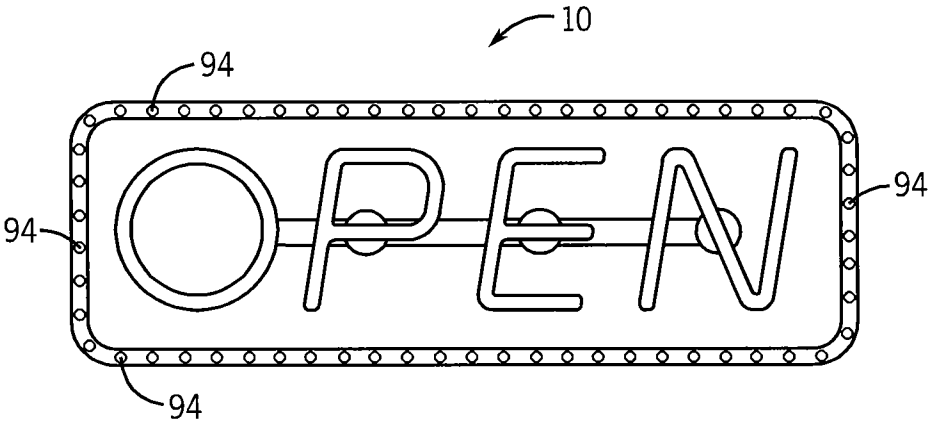
FIGS. 20-21 are front elevation views of another embodiment of the sign according to the present invention in which the sign is shown in two different orientations.
Figure 20:
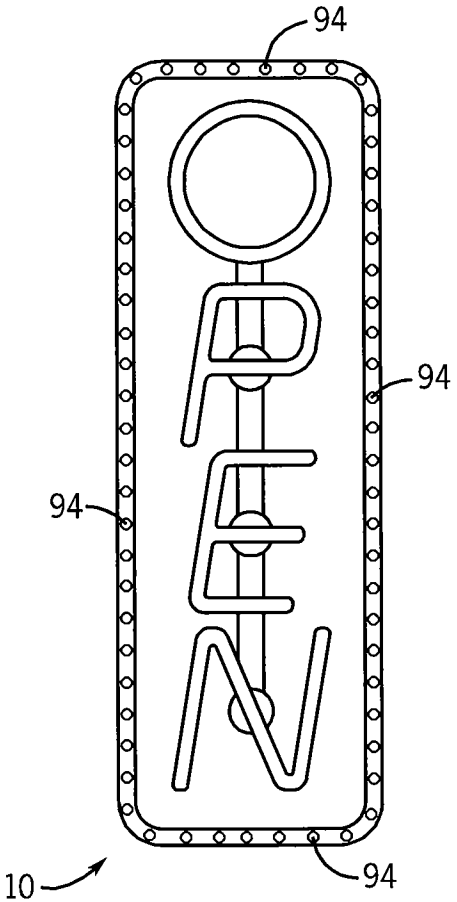
Figure 22:
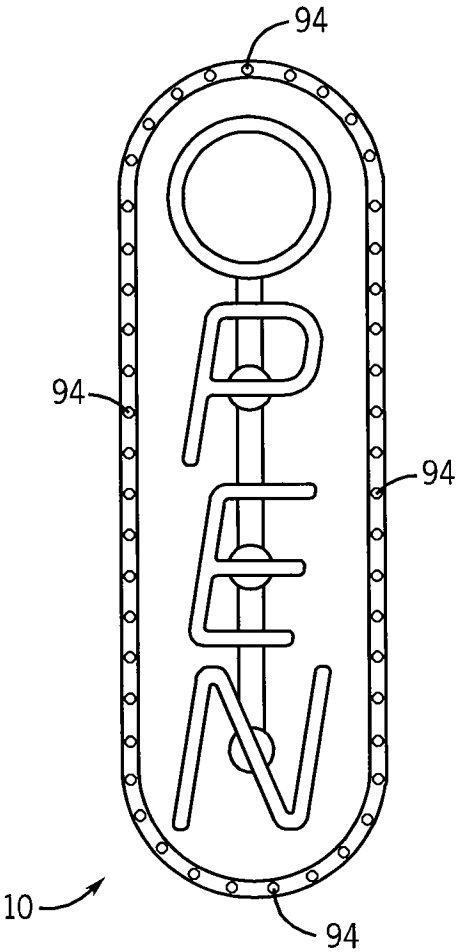
FIGS. 22-23 are front elevation views of another embodiment of the sign according to the present invention in which the sign is shown in two different orientations.
Figure 23:
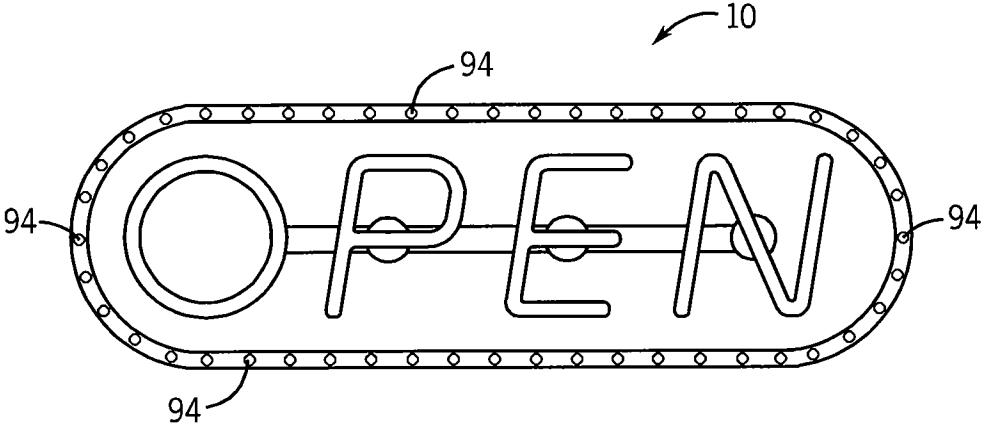
Figure 25:
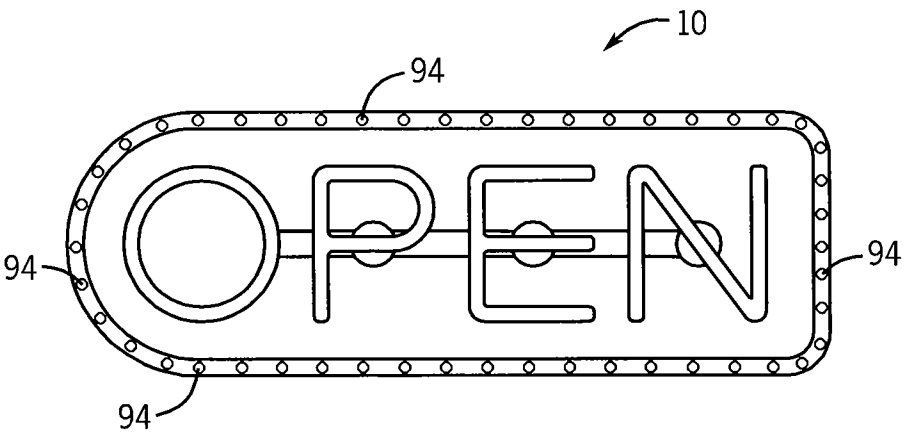
FIGS. 24-25 are front elevation views of another embodiment of the sign according to the present invention in which the sign is shown in two different orientations.
Figure 24:
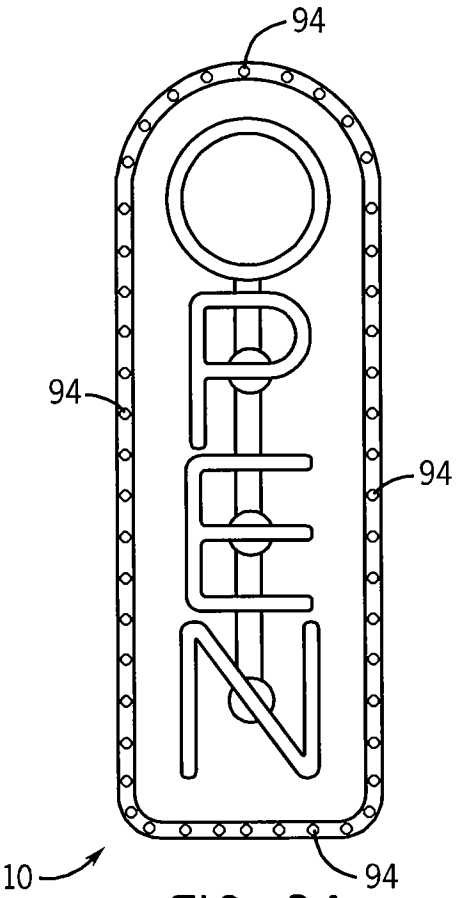
Figure 27:
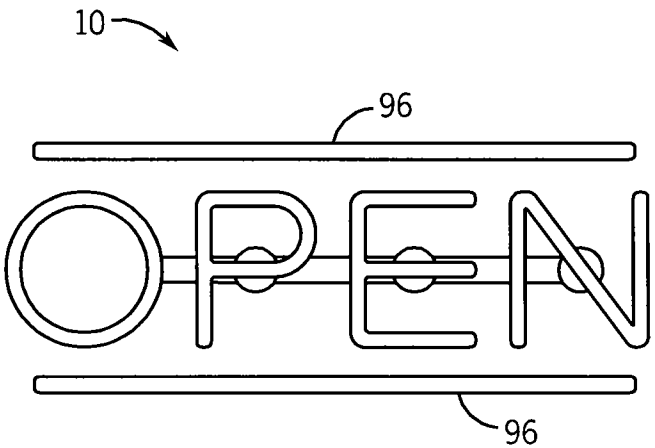
FIGS. 26-27 are front elevation views of another embodiment of the sign according to the present invention in which the sign is shown in two different orientations.
Figure 26:
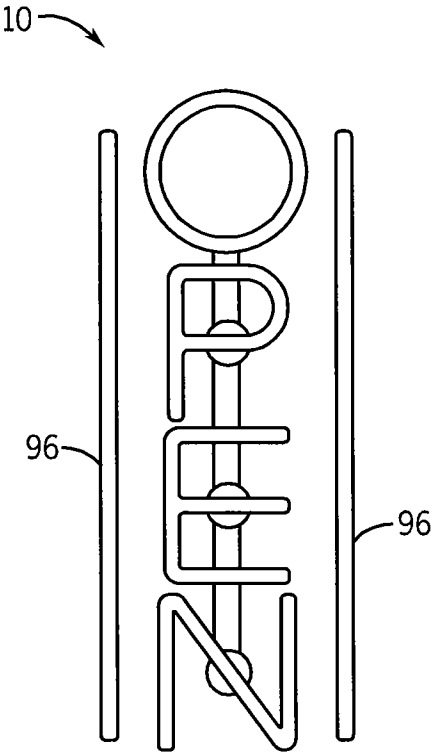
Figure 29:
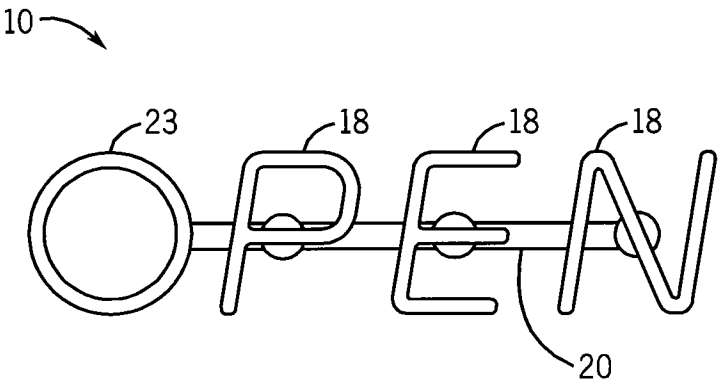
FIGS. 28-29 are front elevation views of another embodiment of the sign according to the present invention in which the sign is shown in two different orientations.
Figure 28:
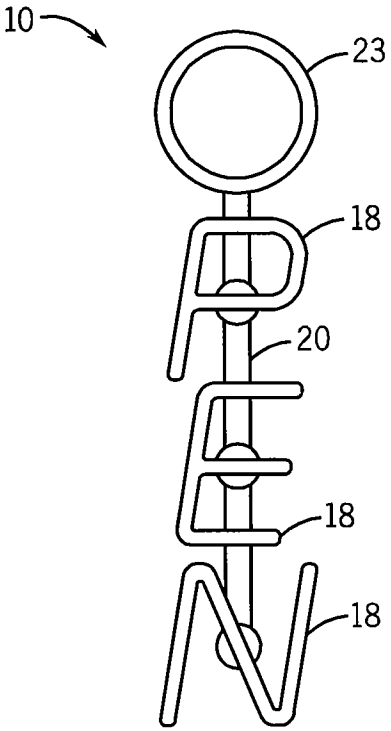

Referring now to FIGS. 14-29, sign 10 according to the present invention may be constructed with a variety of different frames 16. In addition, sign 10 may include additional lighting members positioned around sign 10 for providing sign 10 with an enhanced aesthetic appearance or to improve visibility. For instance, sign 10 may include a pair of arcuate light strips 90 extending above or below sign 10 when in the horizontal orientation or to the left and right of sign 10 when in the vertical orientation. A variety of different arcuate light strips 90 may be provided such as half oval or quarter oval shaped. Alternatively, a single arcuate light strip 92 may be provided around a portion of sign 10 as shown in FIGS. 19-20. Alternatively, a number of individual point light sources 94 may be provided around the perimeter of sign 10, for example, around an exterior surface of frame 16 as shown in FIGS. 20-25 to form a variety of designs around the perimeter of sign 10. FIGS. 26-27 illustrate yet another embodiment of sign 10 according to the present invention wherein sign 10 includes a pair of elongate light strips 96 positioned above and below or to the left and right of sign 10. It is also understood that sign 10 of the present invention may be provided without frame 16 as shown in FIGS. 28-29. Accordingly, sign 10 may simply comprise pivoting letters 18 and a fixed character 23 attached to character mounting member 20 at apertures 22 for selective rotation therein.

Although the best mode contemplated by the inventors of carrying out the present invention is described above, practice of the present invention is not limited thereto. It is further contemplated that various additions, modifications and rearrangements of the features of the present invention may be made without deviating from the spirit and scope of the underlying inventive concept.

Various alternatives and modifications are contemplated as being within the scope of the following claims particularly pointing out and distinctly claiming the subject matter regarded as the invention.

What is claimed is:

1. A sign comprising:

a character mounting frame; and a plurality of characters interconnected with the character mounting frame, including at least one variable position character movably coupled to the character mounting frame via a pivot connection for movement to a plurality of positions relative to the frame, wherein the variable position character is defined by a housing having exterior walls that define the shape of the variable position character, wherein the pivot connection is positioned between the frame and the housing and is located interiorly of boundaries of the character defined by the exterior walls of the housing, wherein the pivot connection enables the at least one variable position character to be moved with respect to the character mounting frame such that the sign may be read in a plurality of positions.

2. The sign of claim 1, wherein the at least one variable position character includes a source of illumination.

3. The sign of claim 2, wherein the exterior walls define a cavity, and wherein the source of illumination comprises one or more LED lights disposed in the cavity.

4. The sign of claim 1, wherein the at least one variable position character comprises a plurality of variable position letters, wherein the variable position letters are configured to display a message when in a first position and configured to display the same message in a different orientation when moved to a second position.

5. The sign of claim 4, wherein the variable position letters are movable to at least a third position and wherein the variable position letters are configured to display the same message when in the third position as in the first and second positions.

6. The sign of claim 1, wherein the pivot connection comprises at least one aperture in the character mounting frame configured to receive and rotatably secure a pivot member interconnected with the housing of the at least one variable position character therein.

7. The sign of claim 1 including a character locking assembly operably coupled to the at least one variable position character, wherein the character locking assembly is configured to selectively prevent movement of the at least one variable position character.

8. The sign of claim 1, further comprising at least one fixed-position character, wherein the fixed-position character is readable in either a first position or a second position without movement thereof.

9. A message display sign that is configured to be displayed in more than one orientation, the message display sign comprising:

a frame defining at least one mounting area; and at least one pivoting character rotatably mounted to the at least one mounting area via a pivot connection, wherein the at least one pivoting character is defined by a hollow housing having exterior walls that define the shape of the pivoting character, wherein the pivot connection is positioned between the frame and the housing and is located interiorly of boundaries of the character defined by the exterior walls of the housing, wherein the pivot connection enables the pivoting character to be pivoted with respect to the frame between a first position wherein the pivoting character may be read in a first orientation and a second position wherein the pivoting character may be read in a second orientation.

10. The message display sign of claim 9, wherein the pivot connection comprises a turntable on the pivoting character that is selectively rotatable with respect to an adjacent mating surface of the frame.

11. The message display sign of claim 10, wherein the turntable includes at least one flange slidingly received within an arcuate slot of the adjacent mating surface of the frame and wherein ends of the arcuate slot define the first position and the second position of the pivoting character.

12. The message display sign of claim 10, wherein the pivot connection further comprises a spacer, wherein the turntable is selectively rotatable with respect to the spacer to rotate the pivoting character.

13. The message display sign of claim 12, wherein the turntable comprises a rod configured to be received by an aperture in the frame, and wherein the spacer is positioned between the turntable and the frame and includes a centrally located hole configured to receive the rod therethrough.

14. The message display sign of claim 12, wherein the turntable includes at least one flange engaged with the spacer to define a path of rotation with respect to the spacer.

15. The message display sign of claim 14, wherein the at least one flange is received within an arcuate slot in the spacer and wherein the ends of the arcuate slot define the first position and the second position of the pivoting character.

16. The message display sign of claim 14, wherein the turntable and the spacer include means for securing the turntable to the spacer such that the pivoting character is secured in one of the first position and the second position.

17. The message of claim 16, wherein the turntable and the spacer include means for securing the turntable to the spacer such that the pivoting character is secured in one of a plurality of additional positions.

18. The message display sign of claim 16, wherein the means for securing the turntable to the spacer comprises a plurality of projections and a corresponding plurality of depressions, wherein the projections are configured to be aligned with the depressions when the pivoting character is in one of the first position and the second position.

19. The message display sign of claim 18, wherein the projections are selectively disengagable from the depressions such that the pivoting character may be rotated between the first position and the second position.

20. The message display sign of claim 9, wherein the at least one pivoting character includes a source of illumination positioned in the housing.

21. The message display sign of claim 20, wherein the hollow housing further comprises a back wall interconnected between the exterior walls and opposite an opening;

a waveguide secured in the opening; and the source of illumination including a plurality of light emitting diodes that are disposed between the back wall of the housing and the waveguide, the light emitting diodes emitting light at the waveguide to thereby illuminate the pivoting character.

22. The message display sign of claim 20, further comprising an electrical connection entering the hollow housing at an axis of rotation of each pivoting character, the electrical connection connecting the source of illumination to a power source.

23. The message display sign of claim 9, wherein the at least one pivoting character comprises a plurality of pivoting characters, and wherein the pivoting characters are arranged in the first orientation to display a message that is readable to an observer.

24. The message display sign of claim 23, wherein the plurality of pivoting characters are arranged in the second orientation to display a message that is readable to an observer.

25. The message display sign of claim 9, further comprising at least one non-pivoting character, wherein the non-pivoting character is arranged so as to be readable in either the first orientation or the second orientation.

26. A sign comprising:

a frame having a plurality of supports, each of the supports receiving one of a pivoting character or a non-pivoting character, wherein the pivoting characters and non-pivoting characters comprise illuminating members comprising, a housing defining a back wall interconnected between a pair of opposed exterior side walls and defining an opening opposite the back wall, wherein the exterior walls define the shape of the character;

a plurality of LEDs supported between the back wall and the opening and positioned to emit light generally toward the opening;

a waveguide secured within the opening and configured to allow light received thereby to be emitted therefrom so that the pivoting characters or non-pivoting characters have an illuminated appearance; and a pivoting assembly disposed between each of the pivoting characters and the corresponding support, the pivoting assembly configured to selectively permit rotation of the pivoting characters between a first position and at least one additional position, wherein the pivoting assembly is positioned between the frame and the housing and is located interiorly of boundaries of the character defined by the exterior walls of the housing;

wherein the non-pivoting characters and pivoting characters are arranged so as to be readable as a message in a first orientation, and wherein the non-pivoting characters and the pivoting characters are arranged so as to be readable as a message in at least a second orientation different from the first orientation.

27. The sign of claim 26 further comprising a conductor that extends through the pivot assembly associated with each pivoting character to communicate power the plurality of LEDs associated with each pivoting character.

28. A sign comprising:

a character mounting frame;

at least one variable position character coupled to the character mounting frame and rotatable relative to the character mounting frame via a pivot connection, wherein the variable position character is configured to be movable with respect to the character mounting frame such that the sign may be read in a plurality of positions, wherein the variable position character comprises a housing defining a back wall interconnected between a pair of opposed exterior side walls and defining an opening opposite the back wall, wherein the exterior walls define the shape of the character, and wherein the pivot connection is positioned between the frame and the housing and is located interiorly of boundaries of the character defined by the exterior walls of the housing;

at least one source of illumination associated with the at least one variable position character for emitting light through the opening; and a conductor electrically connected to the at least one source of illumination and extending between the character mounting frame and the at least one variable position character at the pivot connection between the at least one variable position character and the frame.

* * * * *